US005540851A

United States Patent [19]

Lange

[11] Patent Number: 5,540,851

[45] Date of Patent: Jul. 30, 1996

[54] DISPERSANT-VISCOSITY IMPROVERS FOR LUBRICATING OIL COMPOSITIONS

[75] Inventor: Richard M. Lange, Euclid, Ohio

[73] Assignee: The Lubrizol Corporation, Wickliffe, Ohio

[21] Appl. No.: 397,460

[22] Filed: Mar. 2, 1995

[51] Int. Cl.[6] ..... C10M 145/00; C10M 149/00

[52] U.S. Cl. ..... 508/194; 525/64; 525/285; 508/454

[58] Field of Search ..... 252/51.5 R, 51.5 A; 525/64, 285

[56] References Cited

U.S. PATENT DOCUMENTS

| | | | |
|---|---|---|---|
| 4,077,893 | 3/1978 | Kiovsky | 252/56 R |
| 4,169,063 | 9/1979 | Kiovsky | 252/51.5 A |
| 4,517,104 | 5/1985 | Bloch et al. | 252/51.5 A |
| 4,632,769 | 12/1986 | Gutierrez et al. | 252/48.6 |
| 4,670,173 | 6/1987 | Hayashi et al. | 252/51.5 A |
| 4,803,003 | 2/1989 | Chung | 252/51.5 A |
| 5,035,821 | 7/1991 | Chung et al. | 252/51.5 A |
| 5,049,294 | 9/1991 | Van Zon et al. | 252/51.5 A |
| 5,210,146 | 5/1993 | Gutierrez et al. | 252/301 |

FOREIGN PATENT DOCUMENTS

| | | | |
|---|---|---|---|
| 352070 | 1/1990 | European Pat. Off. . | |
| 0353070 | 10/1992 | European Pat. Off. | C10M 143/02 |

OTHER PUBLICATIONS

Ranney, M. W., "Lubricant Additives", Noyes Data Corp. (1973) pp. 119–136 month unknown.

Ranney, M. W., "Lubricant Additives, Recent Developments", Noyes Data Corp. (1978), pp. 151–159 month unknown.

Ranney, M. W., "Synthetic Oils and Additives for Lubricants, Advances Since 1977", Noyes Data Corp. (1980), pp. 119–150 month unknown.

*Primary Examiner*—Prince Willis, Jr.

*Assistant Examiner*—Cephia D. Toomer

*Attorney, Agent, or Firm*—Joseph P. Fischer; Frederick D. Hunter; James L. Cordek

[57] ABSTRACT

Dispersant-viscosity improvers for lubricating oil compositions comprise the reaction product of reactants comprising (a) an oil soluble ethylene-alpha olefin copolymer wherein the alpha olefin is selected from the group consisting of $C_{3-28}$ alpha olefins, said polymer having a number average molecular weight ranging from about 30,000 to about 300,000 grafted with an ethylenically unsaturated carboxylic acid or functional derivative thereof;

(b-1) at least one polyester containing at least one condensable hydroxyl group; and (b-2) at least one polyamine having at least one condensable primary or secondary amino group, and optionally further comprising (c) at least one hydrocarbyl substituted carboxylic acid or anhydride.

51 Claims, No Drawings

DISPERSANT-VISCOSITY IMPROVERS FOR LUBRICATING OIL COMPOSITIONS

FIELD OF THE INVENTION

This invention relates to dispersant-viscosity improvers for lubricating oils, and oil compositions and concentrates containing such dispersant-viscosity improvers.

BACKGROUND OF THE INVENTION

The viscosity of lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Viscosity improvers are usually polymeric materials and are often referred to as viscosity index improvers.

Dispersants are also well-known in the lubricating art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp. (1978), pp 139–164; and M. W. Ranney, "Synthetic Oils and Additives for Lubricants", Noyes Data Corp. (1980), pp 96–166. Each of these publications is hereby expressly incorporated herein by reference.

Dispersant-viscosity improvers are generally prepared by functionalizing, i.e., adding polar groups, to a hydrocarbon polymer backbone.

Hayashi, et al, U.S. Pat. No. 4,670,173 relates to compositions suitable for use as dispersant-viscosity improvers made by reacting an acylating reaction product which is formed by reacting a hydrogenated block copolymer and an alpha-beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an a alpha-beta unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the performed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Each of these patents is hereby expressly incorporated herein by reference.

For additional disclosures concerning multi-purpose additives and particularly viscosity improvers and dispersants, the disclosures of the following U.S. patents are incorporated herein by reference:

| | | |
|---|---|---|
| 2,973,344 | 3,488,049 | 3,799,877 |
| 3,278,550 | 3,513,095 | 3,842,010 |
| 3,311,558 | 3,563,960 | 3,865,098 |
| 3,312,619 | 3,598,738 | 3,865,268 |
| 3,326,804 | 8,615,288 | 3,879,304 |
| 3,403,011 | 3,637,610 | 4,033,889 |
| 3,404,091 | 3,652,239 | 4,051,048 |
| 3,445,389 | 3,687,849 | 4,234,435 |

It is a primary object of this invention to provide novel multi-purpose lubricant additives.

A more specific object is to provide multi-purpose additives directed to improving lubricant viscosities and dispersancy properties.

A further object is to provide processes for preparing such multi-purpose additives.

Still another object is to provide lubricants having improved dispersancy and viscosity properties.

Other objects will in part be obvious in view of this disclosure and will in part appear hereinafter.

SUMMARY OF THE INVENTION

The present invention is directed to a dispersant-viscosity improver for lubricating oil compositions comprising the reaction product of reactants comprising (a) an oil soluble ethylene-alpha olefin copolymer wherein the alpha olefin is selected from the group consisting of $C_{3-28}$ alpha olefins, said polymer having a number average molecular weight ranging from about 30,000 to about 300,000 grafted with an ethylenically unsaturated carboxylic acid or functional derivative thereof;

(b-1) at least one polyester containing at least one condensable hydroxyl group; and (b-2) at least one polyamine having at least one condensable primary or secondary amino group, and optionally further comprising (c) at least one hydrocarbyl substituted carboxylic acid or anhydride.

DETAILED DESCRIPTION OF THE PREFERRED EMBODIMENTS

According to the present invention, a composition of matter suitable for use as a dispersant-viscosity improver for lubricating oil compositions is the reaction product of an oil-soluble ethylene-alpha olefin copolymer grafted with an ethylenically unsaturated carboxylic acid or functional derivative thereof, at least one polyester containing at least one condensable hydroxyl group and at least one polyamine having at least one condensable primary or secondary amino group and optionally a hydrocarbyl substituted carboxylic acid or anhydride.

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated, in a lubricating oil composition. For a further discussion of the terms oil soluble and dispersible, particularly "stably dispersible", see U.S. Pat. No. 4,320,019 which is expressly incorporated herein by reference for relevant teachings in this regard.

Reactant (a) employed in preparing dispersant-viscosity improvers of this invention is an ethylene-alpha olefin copolymer grafted with an ethylenically unsaturated carboxylic acid or functional derivative thereof.

Examples of graft copolymers (a) employed in this invention are provided hereinafter.

The Ethylene-Alpha Olefin Copolymer

The copolymer onto which acid functionality is grafted is a polymer which consists in its main chain essentially of ethylene and alpha olefin monomers. The polyolefins of the present invention thus exclude polymers which have a large component of other types of monomers copolymerized in the main polymer backbone, such as ester monomers, acid monomers, and the like.

The polymers employed in this invention are polymers of ethylene and at least one other α-olefin having the formula $CH_2=CHR^1$ wherein $R^1$ is straight chain or branched chain alkyl radical comprising 1 to 26 carbon atoms. Preferably $R^1$ in the above formula is alkyl of from 1 to 8 carbon atoms, and more preferably is alkyl of from 1 to 2 carbon atoms. Therefore, useful comonomers with ethylene in this invention include propylene, 1-butene, 1-hexene, 1-octene, 4-methyl-1-pentene, 1-heptadecene, 1-tridecene, 1-tetradecene, 1-pentadecene, 1-hexadecene, 1-heptadecene, 1-octadecene, 1-nonadecene and mixtures thereof (e.g., mixtures of propylene and 1-butene, and the like).

The ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present. Most preferably, the polymers used in this invention are substantially free of ethylene homopolymer, although they may exhibit a degree of crystallinity due to the presence of small crystalline polyethylene segments within their microstructure.

Exemplary of such polymers are ethylene-propylene copolymers, ethylene-co-1-butene copolymers and the like. Preferred polymers are copolymers of ethylene and propylene and ethylene and 1-butene.

The ethylene-alpha olefin copolymer has a number average molecular weight ($M_n$) determined by gel-permeation chromatography employing polystyrene standards, ranging from about 30,000 to about 300,000, more often from about 50,000 to about 150,000, even more often from about 80,000 to 150,000. Exemplary polydispersity values ($M_w/M_n$) range from about 2.2 to about 2.5.

When the molecular weight of the ethylene copolymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673 which is hereby incorporated herein by reference for relevant disclosures in this regard.

Molecular weights of polymers are determined using well-known methods described in the literature. Examples of procedures for determining molecular weights are gel permeation chromatography (also known as size-exclusion chromatography) and vapor phase osmometry. These and other procedures are described in numerous publication including:

P. J. Flory, "Principles of Polymer Chemistry" Cornell University Press (1953), Chapter VII, pp 266–316, and "Macromolecules, an Introduction to Polymer Science", F. A. Bovey and F. H. Winslow, Editors, Academic Press (1979), pp 296–312.

W. W. Yau, J. J. Kirkland and D. D. Bly, "Modern Size Exclusion Liquid Chromatography", John Wiley and Sons, New York, 1979.

A measurement which is complementary to a polymer's molecular weight is the melt index (ASTM D-1238). Polymers of high melt index generally have low molecular weight, and vice versa. The grafted polymers of the present invention preferably have a melt index of up to 20 dg/min, more preferably 0.1 to 10 dg/min.

As used herein the term copolymer refers to interpolymers derived from 2 or more monomers. In the present invention, one monomer is ethylene. The comonomer is at least one $C_{3-28}$ alpha olefin, preferably $C_{3-8}$ alpha olefins. Preferred alpha olefin monomers are propylene, 1-butene, 1-pentene and 1-hexene, with propylene being most preferred.

In a further embodiment, the ethylene copolymer is an ethylene-lower olefin-diene copolymer. As used herein, the term lower refers to groups or compounds containing no more than 8 carbon atoms. Preferably, the diene is non-conjugated.

Useful copolymers include oil soluble or dispersible substantially saturated, including hydrogenated, copolymers of alpha-olefins.

By substantially saturated is meant that no more than about 5% of the carbon to carbon bonds in the polymer are unsaturated. Preferably, no more than 1% are unsaturated, more preferably, the polymer is essentially free of unsaturation.

The polymers employed in this invention may generally be prepared substantially in accordance with procedures which are well known in the art. The polymers for use in the present invention can be prepared by polymerizing monomer mixtures comprising ethylene and alpha-olefins having from 3 to 28 carbon atoms, including monoolefins such as propylene, 1-butene, isobutene, 1-pentene, 1-hexene, 1-heptene, 1-octene, 1-nonene, 1-decene, propylene tetramer, diisobutylene, and triisobutylene; optionally with diolefins such as 1,3-butadiene, 5-ethylidene-2-norbornene, 1,3-pentadiene, isoprene, 1-4-hexadiene, dicyclopentadiene, and mixtures thereof in the presence of a catalyst system as described below. The comonomer content can be controlled through the selection of the catalyst component and by controlling the partial pressure of the various monomers.

The catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

After polymerization and optionally, deactivation of the catalyst (e.g., by conventional techniques such as contacting the polymerization reaction medium with water or an alcohol, such as methanol, propanol, isopropanol, etc., or cooling or flashing the medium to terminate the polymerization reaction), the product polymer can be recovered by processes well known in the art. Any excess reactants may be flashed off from the polymer.

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

In those situations wherein the molecular weight of the polymer product that would be produced at a given set of operating conditions is higher than desired, any of the techniques known in the prior art for control of molecular weight, such as the use of hydrogen and/or polymerization temperature control, may be used.

However, the polymers are preferably formed in the substantial absence of added $H_2$ gas, that is $H_2$ gas added in amounts effective to substantially reduce the polymer molecular weight.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

Alternatively, for use in the present invention, the copolymer may be a hydrogenated polymer or copolymer of one or more conjugated dienes such as isoprene, butadiene and piperylene. For example, upon hydrogenation, 1,4-polyisoprene becomes an alternating copolymer of ethylene and propylene. Such polymers are conveniently prepared via free radical and anionic polymerization techniques. Emulsion techniques are commonly employed for free radical polymerization.

Hydrogenation is usually accomplished employing catalytic methods. Catalytic techniques employing hydrogen under high pressure and at elevated temperature are well-known to those skilled in the chemical art.

An extensive discussion of these hydrogenated diene polymers appears in the "Encyclopedia of Polymer Science and Engineering", Volume 2, pp 550–586 and Volume 8, pp 499–532, Wiley-Interscience (1986), which is hereby expressly incorporated herein by reference for relevant disclosures in this regard.

These copolymers of alpha-olefins may be prepared from branched chain or linear alpha-olefins or mixtures thereof. Ziegler-Natta catalyzed copolymers are exemplary.

The polymers can be random copolymers, block copolymers, and random block copolymers. Ethylene propylene copolymers are usually random copolymers Numerous U.S. patents, including the following, describe the preparation of copolymers of alpha olefins.

| | |
|---|---|
| 3,513,096 | 4,068,057 |
| 3,551,336 | 4,081,391 |
| 3,562,160 | 4,089,794 |
| 3,607,749 | 4,098,710 |
| 3,634,249 | 4,113,636 |
| 3,637,503 | 4,132,661 |
| 3,992,310 | 4,137,185 |
| 4,031,020 | 4,138,370 |
| 4,068,056 | 4,144,181 |

Ethylene-propylene copolymers are the most common copolymers of alpha-olefins and are preferred for use in this invention.. A description of an ethylene-propylene copolymer appears in U.S. Pat. No. 4,137,185 which is hereby incorporated herein by reference.

Useful ethylene-alpha olefin, usually ethylene-propylene copolymers are commercially available from numerous sources including the Exxon, Texaco and Lubrizol Corporations.

There are numerous commercial sources for lower olefin-diene terpolymers. For example, Ortholeum® 2052 (a product marketed by the DuPont Company) which is a terpolymer having an ethylene:propylene weight ratio of about 57:43 and containing 4–5 weight % of groups derived from 1–4 hexadiene monomer, and numerous other such materials are readily available. Such materials and .methods for their preparation are described in numerous patents including the following U.S. patents:

U.S. Pat. No. 3,291,780
U.S. Pat. No. 3,300,459
U.S. Pat. No. 3,598,738
U.S. Pat. No. 4,026,809
U.S. Pat. No. 4,032,700
U.S. Pat. No. 4,156,061
U.S. Pat. No. 3,320,019
U.S. Pat. No. 4,357,250

U.S. Pat. No. 3,598,738, which describes the preparation of ethylene-propylene-1,4-hexadiene terpolymers, is illustrative. This patent also lists numerous references describing the use of various polymerization catalysts.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "Principles of Polymer Chemistry", Cornell University Press, Ithaca, N.Y. (1953), "Kirk-Othmer Encyclopedia of Chemical Technology", 3rd edition, Vol 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts.

As indicated hereinabove, at the end of the polymerization, the reaction may be quenched with alcohol or other suitable reagent and the polymer is recovered.

The Ethylenically Unsaturated Carboxylic Acid Or Functional Derivative Thereof

The ethylenically unsaturated carboxylic acids or functional derivatives are well know in the art; they include such acids as acrylic acid, methacrylic acid, maleic acid, fumaric acid, crotonic acid, citraconic acid, itaconic acid and mesaconic acid, as well as their anhydrides, halides and esters (especially the lower alkyl esters, the term "lower alkyl" meaning alkyl groups having up to 7 carbon atoms). The preferred compounds are the alpha-beta-olefinic carboxylic acids, especially those containing at least two carboxy groups and more especially dicarboxylic acids, and their derivatives. Maleic acid and maleic anhydride, especially the latter, are particularly preferred.

Reactant (a) is prepared by grafting, either by mastication of the neat polymer, or in solution, the ethylenically unsaturated carboxylic acid or functional derivative onto the ethylene copolymer backbone employing techniques that are well-known in the art. Free-radical grafting techniques are usually employed. Thermal grafting by the "ene" reaction using copolymers containing unsaturated sites, such as ethylene-propylene-diene copolymers may be employed.

The ethylenically unsaturated carboxylic acid is generally employed in amounts ranging from about 0.01% to 10% preferably 0.1–5%, more preferably 0.2–2% by weight, based on the weight of polymer.

Free Radical-Generating Reagents

The radical grafting is preferably carried out using free radical initiators such as peroxides, hydroperoxides, and azo compounds which decompose thermally within the grafting temperature range to provide said free radicals.

Free radical generating reagents are well know to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical-generating reagents, also known as free-radical initiators, are mentioned in the above-referenced tests by Flory and by Bovey and Winslow. An extensive listing of free-radical initiators appears in J. Brandrup and E. H. Immergut, Editor, "Polymer Handbook", 2nd edition, John Wiley and Sons, New York (1975), pages II-1 to II40. Preferred free radical-generating reagents include t-butyl peroxide, t-butyl hydroperoxide, t-amyl peroxide, cumyl peroxide, t-butyl peroctoate, t-butyl-m-chloroperbenzoate and azobisisovaleronitrile.

The free-radical initiators are generally used in an amount from 0.01 to about 10 percent by weight based on the total weight of the reactants. Preferably, the initiators are used at about 0.05 to about 1 percent by weight.

The reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer backbone. Improved efficiency of monomer grafting onto substantially saturated copolymer resins has been described in U.S. Pat. No. 5,298,565 which is hereby incorporated herein by reference for relevant disclosures in this regard.

Azo group containing initiators, such as Vazo® polymerization initiators (DuPont) employed in the grafting process at about 95° C. result in a much higher degree of grafting onto the polymer backbone than do peroxide initiators such as t-butyl peroxide, employed at about 150°–160° C. Peresters are particularly effective in the free-radical grafting process.

(b-1) The Hydroxy-Containing Polyester

The use of the hydroxy-containing polyester (b-1) in preparing the compositions of this invention is unique. The hydroxy-containing polyesters are carboxylic compounds which contain at least one condensable hydroxyl group. As defined herein, condensable refers to the group's availability for further reaction with for example, an acylating agent. The polyester (b-1) may be prepared by reacting a hydrocarbyl-substituted polycarboxylic acid or functional derivative thereof, such as an anhydride, with a polyol, or a mixture of polyols wherein the polyol is present in amounts such that the number of hydroxyl groups thereon exceeds the number required to react with all of the available carboxyl groups. Subsequent condensation is usually carried out at high temperatures with removal of volatiles. Thus, the resulting product is a polyester containing unreacted hydroxyl groups. The unreacted hydroxyl groups are available to be condensed with acylating reactants polymeric (a) and monomeric (c).

The polycarboxylic acid employed to prepare the polyesters (b-1) may be illustrated by the general formula $$R—(COOH)_n$$

wherein R is a hydrocarbyl group. R may be aliphatic or aromatic, including alkyl, alkenyl, aralkyl and alkaryl, including mixtures of acids containing aliphatic and aromatic groups. Preferably R is an aliphatic group, and preferably contains from about 5 to about 500 carbon atoms, more preferably from 16 to about 200 carbon atoms, even more preferably from about 30 to about 100 carbon atoms. The subscript 'n' is a number ranging from 2 to about 10, preferably 2 to about 4, more preferably 2 or 3. In an especially preferred embodiment n=2. Mixtures of such acids are also useful and are contemplated for use in preparing the hydroxy containing polyesters of this invention. Such mixtures often impart desirable performance characteristics to the hydroxy-containing intermediate and the products of this invention.

Suitable polycarboxylic acids or anhydrides are hydrocarbyl substituted, preferably oil-soluble. Preferably the hydrocarbyl substituent is aliphatic and contains at least 8 carbon atoms, more preferably at least about 30 carbon atoms. In another embodiment the polycarboxylic acid or anhydride comprises a mixture of hydrocarbyl substituted polycarboxylic acids or anhydrides, especially a mixture comprising aliphatic substituted polycarboxylic acids or anhydrides containing from about 12 to about 24 carbon atoms in the aliphatic substituent and aliphatic substituted polycarboxylic acids or anhydrides having at least about 40 carbon atoms in the aliphatic substituent.

Patents describing useful aliphatic polycarboxylic acids or anhydrides and methods for preparing them include, among numerous others, U.S. Pat. Nos. 3,215,707 (Rense); 3,219,666 (Norman et al), 3,231,587 (Rense); 3,912,764 (Palmer); 4,110,349 (Cohen); and 4,234,435 (Meinhardt et al); and U.K. 1,440,219 which are hereby incorporated by reference for their disclosure of useful carboxylic reactants.

The polyalkenes from which the carboxylic acids reactants may be derived are homopolymers and interpolymers, also referred to herein as copolymers, of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C=CH_2$. However, polymerizable internal olefin monomers (sometimes referred to in the literature as medial olefins) characterized by the presence within their structure of the group $$—C—C=C—C—$$

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Preferred polycarboxylic acids include polyolefin substituted succinic acids, succinic anhydrides, ester acids or lactone acids.

Numerous polycarboxylic acids are commercially available, many from more than one source. The commercially available polycarboxylic acids can be used in the preparation of polyester intermediates used in this invention. While these commercially available polyacids, or their esters may be used by themselves, it is usually beneficial to employ them in combination with polyolefin substituted succinic acids, anhydrides or functional derivatives thereof. Such commercially available polycarboxylic acids and anhydrides include, but are not limited to aliphatic acids such as glutaric, adipic, pimelic, sebacic, azaleic, suberic, dodecanedioic, 5-norbornene dicarboxylic, bicyclooctene dicarboxylic, 2-OH-succinic, citric, tartaric, cyclopentane tetracarboxylic, 5-norbornene-2,3-dicarboxylic, cyclohexene-4, 5-dicarboxylic and cyclohexane dicarboxylic (1,2- 1,3-, and 1,4-). Also useful are aromatic acids and anhydrides such as phthalic, isophthalic, terephthalic, trimellitic anhydride, trimesic, pyromellitic, 2,3-naphthalenedicarboxylic, 2,6-naphthalene dicarboxylic, 1,8-naphthalic, benzophenone tetracarboxylic, and 1,1,3-trimethyl-3-phenylindane-4',5'-dicarboxylic.

Polyacids from vegetable- and animal-sourced carboxylic compounds can be used for preparing polyesters of this invention. Dimer acids, made by the thermal coupling of unsaturated vegetable acids, are available from Emery, Westvaco, Unichema and other companies. Polyacid reaction products of unsaturated vegetable acids with acrylic acid and maleic anhydride are available from Westvaco under the product names Diacid 1550 and Tenax 2010, respectively. Another useful vegetable derived acid is 12-hydroxystearic acid, which can provide both carboxyl and hydroxy functionality to the polyester.

Additionally, polyether alpha,omega-acids, such as 3,6,9-trioxaundecane-1,11-dioic acid and mixed polyglycol diacids available from Hoechst Chemie can also be incorporated into the hydroxy-containing polyesters to impart surface activity and polarity, and to affect morphology at low temperatures.

The carboxylic acid may also comprise up to about 20 equivalent % of the carboxylic acid functionality as monocarboxylic acid, that is, acids where n=1. Such mixtures of acids preferably contain no more than about 10 equivalent % as monocarboxylic acid, more preferably, no more than about 5 equivalent %. Most preferred is where the polycarboxylic acid used to prepare the polyesters used in this invention is essentially free of monocarboxylic acids, that is containing no more than a minor, impurity amount, of monocarboxylic acid.

Monocarboxylic acids which may be present in a mixture with polycarboxylic acids have the formula $R^3COOH$. $R^3$ is a hydrocarbyl group, preferably an aliphatic group. Preferably, $R^3$ contains from about 2 to about 500 carbon atoms. In one preferred embodiment, $R^3$ is an aliphatic group containing from about 8 to about 24 carbon atoms more often from about 12 to about 18 carbon atoms. Examples of such acids are caprylic, capric, palmitic, stearic, isostearic, oleic, linoleic, and behenic acids.

A particularly preferred group of monocarboxylic acids is prepared by the reaction of a polyolefin or a halogenated olefin polymer with acrylic acid or methacrylic acid.

Such polyolefins or olefin oligomers or polymers typically contain from about 12 to about 200 carbon atoms, preferably from about 18, frequently from about 30, up to about 100 carbon atoms. The polyolefin or olefin polymers may be obtained by polymerization of a variety of monoolefins, preferably, alpha olefins, containing from 2 to about 12 carbon atoms, more preferably 3 to 8 carbons, ever more preferably 3 to 4 carbon atoms.

Suitable dicarboxylic acids include the substituted succinic acids having the formula

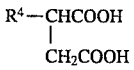

wherein $R^4$ is the same as R and $R^3$ as defined above. $R^4$ is preferably an olefin polymer-derived group formed by polymerization of such monomers as ethylene, propylene, 1-butene, isobutene, 1-pentene, 2-pentene, 1-hexene and 3-hexene. Such groups usually contain from about 30 to about 200, more often up to about 100 carbon atoms. $R^4$ may also be derived from a high molecular weight substantially saturated petroleum fraction. The hydrocarbon-substituted succinic acids and their derivatives constitute the most preferred class of carboxylic acids.

Polycarboxylic acids containing from 3 to 10 carbon atoms are also useful for preparing the polyesters employed in this invention. It is often useful to employ these lower polycarboxylic acids in combination with higher molecular weight polycarboxylic acids when making the intermediate hydroxy-containing polyesters.

The above-described classes of carboxylic acids derived from olefin polymers, and their derivatives, are well known in the art, and methods for their preparation as well as representative examples of the types useful in the present invention are described in detail in the following U.S. patents:

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |
| 3,278,550 | 3,448,048 | 3,632,511 |
| 3,281,428 | 3,454,607 | 3,639,242 |
| 3,306,908 | 3,515,669 | |

Non-limiting examples of compounds useful as polycarboxylic reactants for reaction with polyols to prepare the polyester of this invention include those in the following examples. Parts in the following examples are, unless otherwise indicated, parts by weight. Temperatures are in degrees Celsius (°C.).

EXAMPLE b-1

A mixture of 6400 parts (4 moles) of a polybutene comprising predominantly isobutene units and having a number average molecular weight of about 1600 and 408 parts (4.16 moles) of maleic anhydride is heated at 225°–240° C. for 4 hours. It is then cooled to 170° C. and an additional 102 parts (1.04 moles) of maleic anhydride is added, followed by 70 parts (0.99 mole) of chlorine; the latter is added over 3 hours at 170°–215° C. The mixture is heated for an additional 3 hours at 215° C. then vacuum stripped at 220° C. and filtered through diatomaceous earth. The product is the desired polybutenyl-substituted succinic anhydride having a saponification number of 61.8.

EXAMPLE b-2

A polybutenyl succinic anhydride is prepared by the reaction of a chlorinated polybutylene with maleic anhydride at 200° C. The polybutenyl radical has a number average molecular weight of 805 and contains primarily isobutene units. The resulting alkenyl succinic anhydride is found to have an acid number of 113 (corresponding to an equivalent weight of 500).

EXAMPLE b-3

A lactone acid is prepared by reacting 2 equivalents of a polyolefin (Mn about 900) substituted succinic anhydride with 1.02 equivalents of water at a temperature of about 90° C. in the presence of a catalytic mount of concentrated sulfuric acid. Following completion of the reaction, the sulfuric acid catalyst is neutralized with sodium carbonate and the reaction mixture is filtered.

EXAMPLE b-4

An ester acid is prepared by reacting 2 equivalents of an alkyl substituted succinic anhydride having an average of about 35 carbon atoms in the alkyl group with 1 mole of ethanol.

EXAMPLE b-5

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110° to 188° C. The exothermic reaction is controlled as not to exceed 188° C. The batch is blown with nitrogen then stored.

EXAMPLE b-6

A procedure similar to that of Example b-5 is repeated employing 1000 parts of polybutene having a molecular weight determined by vapor phase osmometry of about 1650 and consisting primarily of isobutene units and 106 parts maleic anhydride. $Cl_2$ is added beginning at 130° C. and added at a nearly continuous rate such that the maximum temperature of 188° C. is reached near the end of chlorination. The residue is blown with nitrogen and collected.

EXAMPLE b-7

A reactor is charged with 1000 parts of $C_{18-24}$ olefin mixture obtained from Albamarle Corporation, Houston, Tex. The material is heated to 65° followed by addition of 350 parts maleic anhydride. The temperature is increased to 213° then held at reflux until the total acid number is between 285–295. The reactor contents are stripped to remove volatile materials until analysis shows % maleic acid is less than 0.30%

EXAMPLE b-8

A reactor charged with 1000 parts of a polybutene having a number average molecular weight of about 1500 and 47.9 parts molten maleic anhydride. The materials are heated to 138° C. followed by chlorination, allowing the temperature to rise to between 188°–191° C., heating and chlorinating until the acid number is between 43 and 49 (about 40–45 parts $Cl_2$ are utilized). The materials are heated at 224°–227° C. for about 2.5 hours until the acid number stabilizes. The reaction product is diluted with 438 parts mineral oil diluent and filtered with a diatomaceous earth filter aid.

The polyhydric alcohols useful in the preparation of the polyester esters may contain up to about 8 hydroxyl groups, and may be linear or branched. The expressions "branched" or "linear" refer to the configuration of the hydrocarbon backbone of the polyhydric alcohol. The polyhydric alcohol will generally contain from two to about 28 carbons. For example, glycerol, containing 3 hydroxy groups is linear and pentaerythritol, with four hydroxyl groups, is branched. Neopentylene glycol, with 2 hydroxyl groups, is branched.

Specific examples of polyhydroxy compounds useful in the present invention include ethylene glycol, diethylene glycol, triethylene glycol, propylene glycol, dipropylene glycol, glycerol, 1,2- and 1-3, propanediol neopentylene glycol, 1,2-, 1-3-, and 1,4-butanediols, 1,4-butenediols, pentaerythritol, dipentaerythritol, tripentaerythritol, triglycerol, trimethylolpropane, sorbitol, hexaglycerol, 2,2,4-trimethyl-1,3-pentanediol, etc. Mixtures of any of the above polyhydroxy compounds can be utilized. Preferred polyhydric alcohols are ethylene glycol, neopentylene glycol, glycerol and pentaerythritol. Diols usually result in essentially linear polyesters, whereas triols and higher polyhydric alcohols may result in the formation of branched polyesters. Also, tri- and higher polyhydric alcohols can provide polyesters containing hydroxyl groups. Pentaerythritol is an especially preferred polyhydric alcohol for preparing the polyesters used in this invention.

The polyhydric alcohols used in the preparation of the polyesters also may include polyethers or partial fatty acid esters of polyols or polyether polyols. Useful polyethers include polyoxyalkene diols, such as diethylene glycol and higher oligo(ethylene oxides), alkoxylated glycerol, ethoxylated trimethyolpropane, etc. Useful partial fatty acid esters will contain at least two free hydroxyl groups. Glycerol monooleate is illustrative of a polyol partial ester.

The polyhydroxy compounds used in the preparation of the polycarboxylic polyesters also may contain one or more nitrogen atoms. For example, the polyhydroxy compound may be an alkanol amine containing from 2 to 6 hydroxy groups. In one preferred embodiment, the polyhydroxy compound is a tertiary alkanol amine containing at least two hydroxy groups and more preferably at least three hydroxy groups. Illustrative of such aminopolyols are diethanolamine, triethanolamine, and alkoxylated $C_4$–$C_{18}$ primary alkyl amines marketed by Pennwalt and Akzo Chemie, the latter under the tradenames Propomeen and Ethomeen.

The carboxylic esters are prepared by reacting at least one carboxylic acid with at least one polyhydroxy compound containing at least two hydroxy groups. The formation of esters by the interaction of carboxylic acids and alcohols is usually acid catalyzed and is a reversible process which can be made to proceed to completion by use of a large amount of alcohol or by removal of water as it is formed in the reaction. However, esterification can be accomplished by non-catalyzed processes, driven to completion by exhaustive dehydration. If the ester is formed by transesterification of a lower molecular weight carboxylic ester, the reaction can be forced to completion by removal of the low molecular weight alcohol formed as a result of a transesterification reaction. The esterification reaction can be catalyzed by either organic acids or inorganic acids. Examples of inorganic acids include sulfuric acids and acidified clays. A variety of organic acids can be utilized including paratoluenesulfonic acid, acidic resins such as Amberlyst 15, etc. Organometallic catalysts include, for example, tetraisopropyl orthotitanate and dibutyltin diacetate.

The amounts of carboxylic acids and polyhydroxy compounds included in the reaction mixture may be varied depending on the results desired. However, sufficient polyhydroxy compound must be present to provide a polyester containing at least one free hydroxyl group per average polyester molecule. When mixtures of acids are reacted with a polyhydroxy compound in accordance with the present invention, the carboxylic acids can be reacted sequentially with the polyhydroxy compounds or a mixture of carboxylic acids can be prepared and the mixture reacted with the polyhydroxy compounds.

Throughout the specification and claims, it should be understood that the polyesters also can be formed by reaction of the polyhydroxy compound with the anhydrides of any of the above-described polycarboxylic acids.

However, it is to be further understood that the acid reactants must be capable of generating a polyester. Accordingly, the acidic reactants will always contain at least 80% of the carboxylic functionality as polyacids capable of forming polyesters. Thus, for example, while monocarboxylic acids may be present in the carboxylic acids used to prepare the polyesters they may be only a minor component of the mixture of acidic reactants, at least 80% being polycarboxylic acids capable of forming polyesters with the polyol reactants.

The formation of polyesters by the reaction of carboxylic acids or anhydrides with the polyhydroxy compounds described above can be effected by heating the acids or anhydrides, the polyhydroxy compounds, and a catalyst if used, to an elevated temperature while removing water or low molecular weight alcohols formed in the reaction. Generally, temperatures of from about 175° C. to about 200° C. or higher are sufficient for the reaction.

The following examples illustrate polyesters (b-1) and processes for preparing polyesters.

EXAMPLE (b-1)-1

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150°–220° C. A mixture of 874 grams (2 carbonyl equivalents) of this succinic anhydride and 104 grams (1 mole) of neopentylene glycol is maintained at 240°–250° C./30 mm for 12 hours. The residue is a mixture of hydroxy containing polyester resulting from the esterification of one and both hydroxy groups of the glycol. Typical analyses are acid number of 10, a number average molecular weight of 5500 and an average of one free condensable —OH per polyester molecular weight.

EXAMPLE (b-1)-2

A mixture of 3225 parts (5.0 carbonyl equivalents) of the polybutene-substituted succinic acylating agent prepared in Example (b-1)-1 and 289 parts (8.5 equivalents based on —OH) of pentaerythritol is heated at 224°–235° C. for 5.5 hours, with removal of volatiles by nitrogen blowing. Then 5204 parts mineral oil are added followed by mixing. The homogeneous mixture is filtered at 130° C. to yield an oil solution of the desired polyester product.

EXAMPLE (b-1)-3

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°–190° C. The mixture is then blown with nitrogen at this temperature for several hours, and the residue is the desired polybutenyl-substituted succinic acylating agent.

A solution of 1000 parts of the above-prepared acylating agent is heated to about 150° C. with stirring, and 109 parts (3.2 equivalents) of pentaerythritol are added with stirring. The mixture is blown with nitrogen and heated to about 220° C. over a period of about 14 hours. The batch is then mixed with 872 parts of mineral oil and filtered using a diatomaceous earth filter aid. The filtrate is an oil solution of the desired carboxylic polyester typically having a number average molecular weight of about 5179.

EXAMPLE (b-1)-4

A reactor is charged with 1000 parts of a polybutenyl-substituted succinic acylating agent prepared as in Example (b-1)-3. At between 160°–175° C. are added 121 parts of pentaerythritol. The materials are heated to 200° C. over 8 hours followed by nitrogen blowing at 204°–210° C. for 8 hours. Water is removed and is collected. Upon completion of the reaction, the materials are diluted with 872 parts of mineral oil and the solution is filtered with a diatomaceous earth filter aid. Typical analyses are acid number=8. The polyester contains about 1.8 —OH groups per repeating unit.

EXAMPLE (b-1)-5

Following essentially the procedure of Example (b-1)-1, a tetrapropenyl-substituted acylating agent is prepared and converted to a pentaerythritol polyester.

EXAMPLE (b-1)-6

A reactor charged with 1000 parts of the $C_{18-24}$ substituted succinic anhydride of Example b-7 and 289 parts of pentaerythritol is heated to 200° C. and is held at 200° C. to 235° C. for 5 hours, removing volatiles by $N_2$ blowing. The materials are diluted with 800 parts of mineral oil and filtered.

EXAMPLE (b-1)-7

A reactor is charged with 1000 parts of The product of Example b-6 and 464 parts of mineral oil. The materials are heated to 140° C. under $N_2$, parts pentaerythritol are added and the materials are heated to 210° C. over 6 hours while removing water employing a sub-surface $N_2$ sparge. At this point 750 parts oil are added and the batch is cooled to 150° C. and filtered.

The carboxylic polyester derivatives which are described above resulting from the reaction of an acylating agent with a polyhydroxy-containing compound such as polyol or aminopolyol may be further reacted with any of the hereinafter described amines, and particularly polyamines.

These polycarboxylic acid derivative compositions are known in the art, and the preparation of a number of these derivatives is described in, for example, U.S. Pat. Nos. 3,957,854 and 4,234,435 which are hereby expressly incorporated herein by reference. The following example illustrates the preparation of the esters wherein an alkanolamine or both an alcohol and an amine are reacted with the acylating agent.

EXAMPLE (b-1)-8

A reactor is charged with 1000 parts of a polybutenyl-substituted succinic anhydride prepared essentially as described in Example (b-1)-3, 109 parts pentaerythritol and 31 parts Polyglycol® 112-3, a polyether polyol obtained by reacting glycerol, propylene oxide and ethylene oxide, having a molecular weight ranging from about 4600 to about 5300. The mixture is heated to 210° C. over 6 hours employing a sub-surface $N_2$ sparge. The materials are cooled to 160° C. and a toluene solution of 19 parts of commercial ethylene polyamine having a % N of about 34 is added over 1 hours followed by heating and $N_2$ sparging at 160° C. for 3 hours. The product is diluted with 800 parts mineral oil and filtered using a diatomaceous earth filter aid.

EXAMPLE (b-1)-9

To the polyester of example (b-1)-3 are added 857 parts of mineral oil and 19.25 parts (0.46 equivalent) of a commercial mixture of ethylene polyamines having an average of about 3 to 10 nitrogen atoms per molecule. The reaction mixture is further stripped of volatiles by heating at 205° C. with nitrogen blowing for 3 hours and filtered. The filtrate is an oil solution (45% 100 neutral mineral oil) of the desired amine-modified carboxylic polyester of about 2850 number average molecular weight which contains 0.35% nitrogen, total base number of 2 and total acid number of 4.

EXAMPLE (b-1)-10l

A reactor equipped with a stirrer, condenser with Dean-Stark trap, thermocouple probe and $N_2$ inlet ($N_2$ at 0.5 standard cubic feet/hour (SCFH)) is charged with 1100 parts of a polybutenyl substituted succinic anhydride prepared according to the procedure of Example (b-1)-3, 146 parts triethanolamine and 125 parts toluene. The mixture is heated to 210° over 4 hours then stirring and heating is continued at this temperature for 26 hours, collecting a clear yellow distillate having pH 7–9 in the Dean-Stark trap. $N_2$ flow is increased to 1.5 SCFH and stirring is continued at temperature for 3 additional hours, cool to 105°, and charge 800 parts mineral oil. The materials are stirred at temperature for 0.5 hour, mixed with a diatomaceous earth filter aid and filtered. The filtrate contains, by analysis, 0.69% N and 0.18% —OH. Total acid no.=1.83; total base no.=22.9.

EXAMPLE (b-1)-11

A reactor is charged with 1000 parts of the polyester of Example (b-1)-7 and heated to 150° C. A solution of 15 parts of a commercial polyamine having about 34% nitrogen and total base number of 41 in 15 parts toluene is added over 0.5 hour. The materials are stirred for 2 hours at 160° C. with $N_2$ sparging, 550 parts mineral oil is added and the solution is filtered.

Other discussions and illustrations of suitable procedures are provided, for example, in LeSuer, U.S. Pat. No. 3,381,022 and U.S. Pat. No. 3,522,179 and Meinhardt et al, U.S. Pat. No. 4,234,435.

(b-2) The polyamine

The polyamine (b-2) contains at least two basic nitrogen atoms and is characterized by the presence within its structure of at least one HN<group. Mixtures of two or more amino compounds can be used in the reaction. Preferably, the polyamine contains at least one primary amino group (i.e., $—NH_2$) and more preferably is a polyamine containing at least two condensable —NH— groups, either or both of which are primary or secondary amine groups. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but polyamines result in carboxylic derivative compositions which exhibit more pronounced viscosity improving properties.

Among the preferred amines are the alkylene polyamines, including the polyalkylene polyamines. The alkylene polyamines include those conforming to the formula $$\begin{array}{c} R^2N-(U-N)_n-R^2 \\ \quad\;\; | \qquad\;\; | \\ \quad\;\; R^2 \qquad\;\; R^2 \end{array}$$

wherein n is from 1 to about 10; each $R^2$ is independently a hydrogen atom, a hydrocarbyl group or a hydroxy-substituted or amine-substituted hydrocarbyl group having up to about 30 atoms, or two $R^2$ groups on different nitrogen atoms can be joined together to form a U group, with the proviso that at least one $R^2$ group is a hydrogen atom and U is an alkylene group of about 2 to 10 carbon atoms. Preferably U is ethylene or propylene. Especially preferred are the alkylene polyamines where each $R^2$ is hydrogen or an amino-substituted hydrocarbyl group with the ethylene polyamines and mixtures of ethylene polyamines being the most preferred. Usually n will have an average value of from 2 to about 7. Such alkylene polyamines include methylene polyamine, ethylene polyamines, butylene polyamines, propylene polyamines, pentylene polyamines, hexylene polyamines, heptylene polyamines, etc. The higher homologues of such amines and related amino alkyl-substituted piperazines are also included.

Alkylene polyamines useful in preparing the compositions of this invention include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologues as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7 pages 27–39, Interscience Publishers, Division of John Wiley and Sons, 1965, and in Meinhardt et al, U.S. Pat. No. 4,234,435, both of which are hereby incorporated by reference for the disclosure of useful polyamines. Such compounds are prepared most conveniently by the reaction of an alkylene dichloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher linear and branched analogs of diethylenetriamine, triethylenetetramine and the like.

In another embodiment, the polyamine may be a hydroxyamine provided that the polyamine contains at least one condensable —N—H group. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamine contains up to seven amino groups.

In one embodiment, the polyamine (b-2) is the reaction product of any of the aforementioned polyamines with a carboxylic acid or anhydride wherein the resulting product contains at least one condensable N—H group. Such a material may be obtained by employing an excess of amine reactant relative to the carboxylic reactant.

Suitable polyamines of this type include, but are not limited to the reaction product of mono- and poly- carboxylic acids and functional derivatives thereof, such as anhydrides, with at least one polyamine, preferably an alkylene polyamine as defined hereinabove, containing at least two condensable —N—H groups provided that the resulting product contains at least one condensable N—H group. Exemplary of the patent literature relating to such materials are U.S. Pat. Nos. 3,172,892; 3,219,666; 4,234,435 each of which is expressly incorporated herein by reference, and numerous others.

In a further embodiment, the reaction product of amine and carboxylic reactant may be borated by treatment with a borating agent such as boric acid, boric anhydride and the like. Preferred borating agents are inorganic and boric acid is especially preferred.

The reaction product of amine and carboxylic reactant itself may be reacted with a wide variety of other reactants. Exemplary reagents include carbon disulfide, $H_2S$, boron containing reagents such as boric acid, boron anhydride, boron esters, and the like, sulfur, sulfur chloride, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde producing compounds plus phenols.

Examples of reaction products useful as component b-2 include:

EXAMPLE (b-2)-1

A reaction flask is charged with 698 parts of mineral oil and 108 parts of a commercial polyethylene polyamine mixture having typical % N=34. The materials are stirred and heated to 135° C. at which time 1000 parts of a polybutene substituted succinic anhydride prepared according to the procedure of Example b-1 are added over 1 hour. With $N_2$ sparging, the temperature is increased to 160° C. and held there for 4 hours while removing water and other volatile components. The product is filtered using a diatomaceous earth filter aid yielding a filtrate typically containing 2% N and a total base number of 45.

EXAMPLE (b-2)-2

The procedure of example (b-2)-1 is repeated except that before filtration, the materials are reacted with 28 parts of terephthalic acid at 160° for three hours. The product has typical analyses of 1.9% N and a total base number=35.

EXAMPLE (b-2)-3

The procedure of Example (b-2)-1 is repeated except that before filtration the materials are reacted with 21 parts $CS_2$ to give a sulfur and nitrogen containing condensate.

EXAMPLE (b-2)-4

A polybutene having a number average molecular weight=1350 (1000 parts) is reacted with 106 parts maleic anhydride with $Cl_2$ blowing (total $Cl_2$ about 90 parts). To a reactor containing 1000 parts of the substituted succinic anhydride is added 1050 parts mineral oil, the materials are heated, with mixing, to 120° C., followed by addition of 70 parts of the commercial amine mixture described in Example (b-2)-1. The reaction mixture is heated to 155° C. over 4 hours with $N_2$ sparging to remove volatiles then filtered employing a diatomaceous earth filter aid. The filtrate typically contains, by analysis, 1.1% N and has a total base number=20.

EXAMPLE (b-2)-5

An acylated polyamine is prepared by reacting 1000 parts of polyisobutenyl ($M_n$ 1000) substituted succinic anhydride with 85 parts of a commercial ethylene polyamine mixture having an average nitrogen content of about 34.5% in 820 parts mineral oil diluent under conditions described in LeSuer U.S. Pat. No. 3,172,892.

EXAMPLE (b-2)-6

A boron containing composition is prepared by reacting a mixture of 275 parts mineral oil, 147 parts of a commercial ethyleneamine mixture having an average composition corresponding to that of tetraethylenepentamine and 1000 parts of polyisobutene ($M_n$≈1000) substituted succinic anhydride at 120°–125° C. for 2 hours and at 150° C. for 2 hours then blown with nitrogen at 150° C. for 5 hours to form an acylated amine. To a slurry of 239 parts boric acid in 398 parts mineral oil there is added 1405 parts of above acylated amine over a period of 2 hours. The mixture is heated to 150° C. for 7 hours and filtered employing a diatomaceous earth filter aid to give a liquid product typically containing, by analysis, 1.9% B and 2.3% N.

EXAMPLE (b-2)-7

A solution of 698 parts mineral oil and 108 parts commercial ethylene polyamine mixture containing an average of about 34% nitrogen is prepared and heated to 115° C. To the oil solution is added 1000 parts of the polybutenyl-substituted succinic anhydride of Example (b-1)-3 under $N_2$ followed by heating to 150° C. The reaction is continued at 143°–150° C. for 1 hour. The product is then filtered.

EXAMPLE (b-2)-8

The procedure of Example (b-2)-4 is repeated except the polybutenyl group on the substituted succinic anhydride is derived from a polyisobutene having a number average molecular weight, measured by vapor phase osmometry, of about 1700.

(c) The Hydrocarbyl Substituted Carboxylic Acid or Anhydride

Optionally, the compositions of this invention are prepared employing an additional reactant (c), a carboxylic acid or anhydride. Suitable carboxylic acids or anhydrides are hydrocarbyl substituted, preferably oil-soluble. These may be aromatic, cycloaliphatic and aliphatic acids. Preferably the hydrocarbyl substituent is aliphatic and contains at least 8 carbon atoms, more preferably at least about 30 carbon atoms. In another embodiment (c) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

Suitable carboxylic acids and anhydrides include those described hereinabove with reference to the polyester (b-1).

Patents describing useful aliphatic carboxylic acids or anhydrides and methods for preparing them include, among numerous others, U.S. Pat. Nos. 3,215,707 (Rense); 3,219,666 (Norman et al), 3,231,587 (Rense); 3,912,764 (Palmer); 4,110,349 (Cohen); and 4,234,435 (Meinhardt et al); and U.K. 1,440,219. These patents are hereby incorporated herein by reference for relevant disclosures contained therein.

As indicated in the above-mentioned patents, which are hereby incorporated by reference for their disclosure of compounds useful as component (c) of this invention, the carboxylic acids (or various derivatives thereof) include those derived by the reaction of an alpha, beta-unsaturated carboxylic acid containing compound with a polyalkene or halogenated derivative thereof or a suitable olefin.

The polyalkenes from which the carboxylic acids (c) may be derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C=CH_2$. However, polymerizable internal olefin monomers (sometimes referred to in the literature as medial olefins) characterized by the presence within their structure of the group $$-C-C=C-C-$$

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Preferred carboxylic acids include polyolefin substituted succinic acids, succinic anhydrides, ester acids or lactone acids.

In another preferred embodiment, the acid or anhydride (c) may contain from about 8 to 28 carbon atoms. When these are aliphatic acids, preferably predominantly linear acids, they tend to provide friction reducing characteristics to lubricating oils comprising the dispersant-viscosity improvers of this invention which incorporate such acids therein.

Particularly useful acids are hydrocarbyloxypolyalkyleneoxycarboxylic acids. Some examples of the hydrocarbyloxypolyalkyleneoxycarboxylic acids include: isostearyl-O-$(CH_2CH_2O)_5CH_2CO_2$; lauryl-O-$(CH_2CH_2O)_{2.5}$—$CH_2CO_2H$; lauryl-O-$(CH_2CH_2O)_{3.3}CH_2CO_2H$; oleyl-O-$(CH_2CH_2O)_4$— $CH_2CO_2H$; lauryl-O-$(CH_2CH_2O)_{4.5}CH_2CO_2H$; lauryl-O-$(C_3H_6O)_x(CH_2CH_2O)_yCH_2CO_2H$, wherein x=2–3 and y=1–2, lauryl-O-$(CH_2CH_2O)_{10}$—$CH_2CO_2H$ lauryl-O$(CH_2CH_2O)_{16}$—$CH_2CO_2H$; octylphenyl-O-$(CH_2CH_2O)_8CH_2CO_2H$; octylphenyl-O-$(CH_2CH_2O)_{19}CH_2$—$CO_2H$; and 2-octadecanyl-O-$(CH_2CH_2O)_6CH_2CO_2H$. In one embodiment, the hydrocarbyloxypolyalkyleneoxycarboxylic acid is stearyl pentaethyleneglycolacetic acid, preferably it is isostearylpentaethyleneglycolacetic acid. Some of these acids are available commercially from Sandoz Chemical under the tradename Sandopan Acids.

Other similar polyoxyalkylene carboxylic acids that have methoxy terminal groups, such as 3,6,9-trioxa-decanoic acid are marketed by Hoechst Chemie.

Other acids useful as (c) are aromatic acids such as benzoic, salicylic, hydroxynaphthoic and heterocyclic acids, for example, pyridine dicarboxylic acid.

As discussed hereinabove, the compositions of the present invention are prepared by reacting (a) an acylated ethylene-alpha olefin copolymer with (b-1) a polyester and (b-2) a polyamine and optionally (c) a hydrocarbyl substituted carboxylic acid or anhydride.

The acylated ethylene-alpha olefin copolymer (a) and hydroxy-containing polyester (b-1) are reacted in ratios ranging from about 1 C=O in (a) to about 1 OH in the polyester (b-1) up to about 1 C=O from (a) to about 20 OH from (b-1), preferably 1 C=O to about 5 OH up to about 1 C=O to about 10 OH. In another embodiment, (a) and (b-1) are reacted in amounts ranging from about 4–16 OH per C=O, more often from about 8–14 OH per C=O.

It is recognized that it is unlikely that 100% of the C=O will react with the OH-containing polyester. The remaining acid functionality, e.g., from acid or anhydride, etc., is available to react with the polyamine (b-2). Preferably, the polyamine is present in amounts sufficient to react with at least about 50% of the unreacted acid functionality, more often at least about 75% of the acid functionality. Large excesses of polyamine are desirably avoided in order to reduce attack on ester groups from the polyester or the acylated resin-hydroxy-containing polyester.

Reactant (c) may be employed to react with remaining OH groups or N—H groups that have not reacted with C=O from (a).

The reactions are generally conducted at elevated temperatures, usually at temperatures ranging frown about 100° C. to about 300° C. or even higher, but below the decomposition temperature of any of the reactants or products. Typical temperatures are those given in the following examples.

Compositions of this invention may be prepared by reacting the reactants in a variety of ways. For example (c) may be first reacted with one of (b-1) and (b-2) before reaction with (a). In another embodiment, (c) is reacted with the product formed by reacting (a), (b-1) and (b-2) or may be reacted simultaneously with (a), (b-1) and (b-2). In a further embodiment, (b-2) is first reacted with (a) and the product so obtained is then reacted with (b-1). Alternatively, (b-1) may be first reacted with (a) before reaction with (b-2), or (b-1) may be reacted with (b-2) before reaction with (a).

The following examples are intended to illustrate several compositions of this invention as well as means for preparing same.

EXAMPLE 1

Part A

A reactor equipped with a stirrer, gas inlet, wide-mouth addition funnel, thermowell and condenser is charged with 5950 parts of hydrotreated 100 neutral paraffinic oil. The oil is heated, under nitrogen sweep at 0.4 standard cubic feet per hour (SCFH) to 160° C. At this temperature, 1050 parts of an ethylene-propylene copolymer (52% ethylene, 48% propylene, by weight) having a weight average molecular weight ($M_w$) of 210,000 and an $M_w/M_n$ ($M_n$=number average molecular weight) of 1.8 is added as small pieces (about ½–⅜" cubes) over 3 hours. After 4 hours at 160° C. all polymer appears to have dissolved, but the mixture is stirred for 16 hours additional at 160° C.

Part B

The solution is cooled to 130° C., nitrogen flow is reduced to 0.05–0.1 SCFH and 15.3 parts maleic anhydride is charged followed by stirring for 0.25 hours. A solution of 15.3 parts of tertiary butyl peroxybenzoate in 20 parts of toluene is added dropwise over one hour followed by mixing 3 hours at 130°–135° C. The temperature is increased to 160° C. and the reaction mixture is nitrogen stripped at 2 SCFH for 4 hours to remove toluene and residual maleic anhydride. Saponification number=1.7; viscosity (100° C.)= 7258 centistokes.

Part C

A reactor equipped with stirrer, gas inlet, addition funnel, thermowell, Dean-Stark trap and cold-water condenser is charged with 1000 parts of the product of example 1-B and 492 parts of mineral oil. The materials are heated to 130° C. while sweeping with nitrogen at 0.3–0.4 SCFH. As heating is continued, 500 parts of the oil solution of the hydroxy-containing polyester of example (b-1)-3 are added in a continuous stream over 0.1 hours. The temperature is held at 150° C. for 2 hours. Over 0.5 hours, 8 parts of an ethylene-amine bottoms identified as HPA-X amines (Union Carbide) are added dropwise over about 0.1 hours. The mixture is heated to 160° C. while nitrogen sparging is increased to 1.0–1.5 SCFH. Heating is continued for 3 hours at 160° C. The Dean-Stark trap contains 0.3 milliliters water and 0.1 milliliters organic liquid. Theory analyses are 0.17% N, total acid number=1.0 and total base number=2.6.

EXAMPLE 2

Part A

A three liter flask equipped with a stirrer, reflux condenser, thermowell, and subsurface nitrogen sparging tube is charged with 1950 parts of 11.5 weight percent solution of Ortholeum 2052 a terpolymer containing about 48 weight percent ethylene units, 48 weight percent propylene units and 4 weight percent 1,4-hexadiene units, (E. I. DuPont DeNemours and Company) in 100 neutral solvent extracted diluent oil, containing additionally 3 weight percent of fumarate-vinyl acetate polymeric pour point depressant and 0.12 weight percent phenolic antioxidant. The solution is heated to 80° C. under a slow nitrogen sparge followed by addition of 21.8 parts of maleic anhydride. Stirring is continued while the reaction mixture is heated to 220° C. The mixture is held at this temperature for 8 hours, then blown with nitrogen at an increased rate to remove volatile materials. The solution is cooled to 150° C. and filtered using a diatomaceous earth filter aid yielding 1918 parts of viscous product having a total acid number of 2.4.

Part B

A reactor equipped with mechanical stirrer, reflux condenser, thermowell and subsurface nitrogen sparging tube is charged with 300 parts of the oil solution of Example 2, Part A, 50 parts mineral oil diluent and 150 parts of the polyester solution of Example (b-1)-3. The mixture is stirred while heating to 150° C. under a slow nitrogen sparge and is held at that temperature for 1.5 hours. A solution of 2.5 parts of polyethyleneamine bottoms in 10 milliliters of xylene is added dropwise with stirring over 0.2 hours, followed by stirring for an additional hour. The material is nitrogen blown for one hour to remove volatiles (none collected), then cooled yielding a product containing 27 weight percent active agent, having bulk viscosity of 1275 centistokes at 100° C. and nitrogen content, by analysis, of 0.18%.

EXAMPLE 3

Part A

A solution of 150 parts Ortholeum 2052 and 850 parts of 100N hydrotreated paraffinic oil is prepared under 135° C. under a nitrogen atmosphere. The solution is cooled to 90° C., 5 parts of maleic anhydride is added and the solution is heated to 135° C. under a nitrogen atmosphere. The solution is held at that temperature while a solution of 2 parts tertiary-butyl peroxide in 10 parts xylene is added over a one hour period with rapid stirring. The solution is held at 135° C. for an additional 2 hours then slowly heated to 155° C. over the next hour. The solution is blown with nitrogen over one hour at 155° C. to remove volatile materials (none collected), then cooled to yield a polymer solution containing 15% active agent having a total acid number of 2.0.

Part B

A reactor is charged with 350 parts of the oil solution of Example 3-A, 58 parts of 100N diluent oil and 175 parts of the product of Example (b-2)-5. The mixture is heated to 150° C. and held there for one hour with good stirring under a nitrogen atmosphere. Then, 65 parts of the polyester solution of Example (b-1)-3 is added and the mixture is stirred at 150° C. for an additional 2 hours. The reaction product is filtered employing a diatomaceous earth filter aid yielding an oil solution containing 35 weight percent active agent and having a bulk viscosity of 796 centistokes at 100° C.

EXAMPLE 4

A reactor equipped with a stirrer, thermometer and gas inlet is charged with 600 parts of the maleinated ethylene-propylene copolymer of EXAMPLE 1-B. The solution is heated to 150° C. under $N_2$ followed by addition of 180 parts of the polyester-oil solution of Example (b-1)-3. The materials are mixed with stirring, for 0.5 hours at 150° C. In a slow stream, 120 parts of the borated composition of Example (b-2)-6 are added over 0.2 hours followed by mixing and heating to 160° C. then mixing at 160° C. for 3 hours. The solution contains, by analysis, 0.38% N and 0.22% B; total acid number is 4.1 and total base number is 7.3. Viscosity at 100° C.=4550 centistokes.

EXAMPLE 5

A reactor equipped with a stirrer at 500 rpm, a thermal probe and $N_2$ sparge at 0.5 SCFH is charged with 286 parts of a maleinated ethylenepropylene copolymer prepared according to the procedure of EXAMPLE 1-B, 143 parts of the nitrogen-containing polyester of Example (b-1)-9 and 143 parts mineral oil. The materials are heated to 150° and held at that temperature for 6 hours. The resulting product contains, by analysis, 0.22% N and has total acid no.=0.9 and total base no.=5.2.

EXAMPLE 6

A reactor equipped as described in EXAMPLE 6 is charged with 257.4 parts of the maleinated ethylene-propylene resin of EXAMPLE 6, 102.96 parts of the product of Example (b-1)-5 , 64.35 parts of the product of Example(b-2)-5 and 90.09 parts of mineral oil. The materials are mixed and heated to 150° followed by stirring at temperature for 6 hours. The product contains, by analysis, 0.41% N and has total acid no.=0.88 and total base no.=4.8.

EXAMPLE 7

Part A

A reactor equipped with thermowell, condenser, stirrer and subsurface $N_2$ inlet is charged with 2420 parts mineral oil. Over 0.5 hours are added, with stirring, 427 parts of a copolymer containing, by analysis, ethylene and propylene units in a weight ratio of 57:43, containing 1.4% by weight units derived from dicyclopentadiene and having polydispersity ($M_w/M_n$=2.2. $N_2$ sparging is at 0.2 SCFH. The material are heated to 160° C. and held at 160° C. overnight to dissolve the polymer. To this solution are added 4.3 parts maleic anhydride. The materials are stirred to dissolve maleic anhydride and the condenser is washed with about 5 parts toluene. Over 1 hour, at 160° C. are added, dropwise, 4.3 parts t-butyl peroxide. The reaction is held at 160° C. for 2 hours the $N_2$ sparging is increased to 1.5 SCFH for 3 additional hours to remove volatiles.

Part B

A reactor equipped with stirrer, thermometer and below surface $N_2$ inlet is charged with 190 parts of the product of EXAMPLE 7, Part A, 95 parts of the polyester of Example (b-1)-3 and 30.2 parts mineral oil. The materials are heated, with mixing, to 150° C. and are held at 150° C. for 1 hour. The mixture is cooled to 110° C., 1.52 parts of a commercial polyamine mixture (E-100, Dow) is added, the temperature is increased to 150° C. and heating is continued at this temperature for 3 hours ($N_2$ increased to 1.5 SCFH during last hour to remove volatiles). The reaction product contains, by analysis, 0.15% N, has total acid number of 0.6 and total base number 3.5.

EXAMPLE 8

The procedure of EXAMPLE 7, Part B is repeated except the polyamine is added from an addition funnel which is then flushed with toluene, adding the toluene flushings to the reaction mixture. After the reaction is completed, the materials are filtered at 130° C. with a diatomaceous earth filter aid.

EXAMPLE 9

Part A

A reactor equipped with a stirrer, condenser, thermowell and sub-surface $N_2$ inlet is charged with 6375 parts mineral oil, then with stirring, 1125 parts Ortholeum 2052 are added over 0.5 hour. $N_2$ sparging is at 0.2 SCFH. The materials are heated to 157° C. and held at 157°–160° C. for 6 hours to dissolve the polymer. To the solution are added 11.5 parts maleic anhydride, stirring is continued until the maleic anhydride is dissolved, then, over 1 hour, 11.5 parts di-tertiary-butyl peroxide are added. The reaction is held at 157°–160° C. for 1 hour, then $N_2$ is increased to 1.0 SCFH, removing volatiles at 163°–166° C.

Part B

A reactor equipped as described in EXAMPLE 8 is charged with 1917 parts of the product of EXAMPLE 9, Part A, 309 parts mineral oil and 975 parts of the polyester of Example (b-1)-3. The materials are heated to 150° C., $N_2$ sparging at 0.2 SCFH. Heating is continued at 150° C. for 1 hour followed by cooling to 110° C. Ethylene polyamine (E-100, Dow), 15.6 parts, is added dropwise over 0.2 hour. The temperature is increased to 150° C. and held at 150° C. for 2.5 hours. The materials are filtered at 110° C. yielding a filtrate containing, by analysis, 0.21% N.

EXAMPLE 10

A reactor is charged with 300 parts of the maleinated Ortholeum 2052 of Example 3, Part A, 75 parts of the product of Example (b-2)-7 and 50 parts of the polyester of Example (b-1)-3. The materials are heated under $N_2$ to 150° C. and held at 150°–153° C. for 2 hours.

EXAMPLE 11

Part A

Maleic acid modification of Ortholeum 2052 is carried out in a Brabender twin-screw extruder having three heated zones, 125° C., 150° C. and 170°, over the length of the feeding screws. The screw configurations are set for feeding, mastication (using a different thread pitch to increase back pressure on the reactants and slow extrusion at atmospheric pressure. The polymer (97.5 parts, is cut into small pieces and fed into the extruder at a constant screw rotation rate of 50 revolutions per minute (RPM) while separate solutions of 2 parts maleic anhydride in 10 parts warm toluene and 1 part di-tertiary butyl peroxide in 10 parts toluene are fed in simultaneously, dropwise over the same time. The masticated mixture passes through the heated zones and is slowly extruded as a thin thread which is passed through a cold water bath and is subsequently chopped into small pellets.

Part B

Employing the same extruder described in Part A, with hot zones at 100° C., 125° and 150° C., 100 parts of the pellets of Part A are fed into the inlet of the extruder together with a steady stream of 350 parts of the polyamine-treated hydroxyl-containing polyester of Example (b-1)-9.

EXAMPLE 12

A solution of 150 parts of the product of EXAMPLE 11-A in 850 parts mineral oil having viscosity 4.5 centistokes is mixed with 500 parts of the product of Example (b-1)-9, heated to 150° C. and held at 150° C. with stirring and $N_2$ purging for 2 hours.

EXAMPLE 13

A reactor is charged with 800 parts of the maleic anhydride grafted Ortholeum 2052 described in EXAMPLE 3-A and 200 parts of polyalphaolefin oil having viscosity at 100° C. of 4.5 centistokes. The solution is heated to 125° C. with stirring under a $N_2$ purge the 300 parts of the hydroxy-containing polyester of Example (b-1)-2 is added over 0.1 hour. The mixture is heated to 160° C. with stirring and 200 parts of the reaction product of Example (b-2)-4 are charged followed by heating for 2 hours at 160° C.

EXAMPLE 14

A reactor is charged with 257 parts of the maleinated resin of EXAMPLE 1-B, 103 parts of the nitrogen-containing polyester of Example (b-1)-10, 64 parts of the product of Example (b-2)-5 and 90 parts mineral oil. The reactants are heated to 150° C. with $N_2$ sparging at 0.5 SCFH. The reaction is continued for 6 hours while maintaining 150° C. and $N_2$ at 0.5 SCFH. The product contains, by analysis, 0.41% N, total acid number of 0.88 and total base number 4.8.

The Oil of Lubricating Viscosity

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types.

Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans and the like, silicon-based oils such as the polyalkyl-, polyaryl-, polyalkoxy-, or polyaryloxy-siloxane oils and silicate oils.

Hydrotreated naphthenic oils are well known.

Many viscosity improvers, and particularly functionalized dispersant viscosity improvers such as acylated polyolefins reacted with amines or alcohols are not readily compatible with certain types of oils of lubricating viscosity, notably polyolefin oils and hydrotreated oils. The dispersant viscosity improvers of this invention display outstanding compatibility with these oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in sen, ice. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions of this invention may contain minor amounts of other components. The use of such additives is optional and the presence thereof in the compositions of this invention will depend on the particular use and level of performance required. The compositions may comprise a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and antioxidancy performance.

In addition to zinc salts of dithiophosphoric acids discussed hereinabove, other additives that may optionally be used in the lubricating oils of this invention include, for example, detergents, dispersants, viscosity improvers, oxidation inhibiting agents, metal passivating agents, pour point depressing agents, extreme pressure agents, anti-wear agents, color stabilizers and anti-foam agents. The above-mentioned dispersants and viscosity improvers are used in addition to the additives of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Multifunctional viscosity improvers, other than those of the present invention, which also have dispersant and/or antioxidancy properties are known and may optionally be used in addition to the products of this invention. Such products are described in numerous publications including those mentioned in the Background of the Invention.. Each of these publications is hereby expressly incorporated by reference.

Pour point depressants are a particularly useful type of additive often included in the lubricating oils described herein. See for example, page 8 of "Lubricant Additives" by C. V. Smalheer and R. Kennedy Smith (Lezius-Hiles Company Publisher, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials.

Examples of these "carboxylic dispersants" are described in British Patent number 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight, more often from about 1% to about 12% by weight.

The compositions of the present invention are present in a minor amounts, often amounts ranging from about 1% to about 20% by weight, more often from about 3% to about 10% by weight, even more often from about 5% to about 8% by weight.

The various additives described herein can be added directly to the lubricant. Preferably, however, they are diluted with a substantially inert, normally liquid organic diluent such as mineral oil, naphtha, benzene, toluene or xylene, to form an additive concentrate. These concentrates usually comprise about 0.1 to about 80% by weight of the compositions of this invention and may contain, in addition, one or more other additives known in the art or described hereinabove. Concentrations such as 15%, 20%, 30% or 50% or higher may be employed.

The lubricating compositions of this invention are illustrated by the examples in the following Tables. The lubricating compositions are prepared by combining the specified ingredients, individually or from. concentrates, in the indicated amounts and oil of lubricating viscosity to make the total 100 parts by weight. The amounts shown are indicated as parts by weight or parts by volume. Unless indicated otherwise, where components are indicated as parts by weight, they are amounts of chemical present on an oil-free basis. Thus, for example, an additive comprising 50% oil used at 10% by weight in a blend, provides 5% by weight of chemical.

Where percentages of components are on a volume basis, the examples indicate the amounts of diluent (if any) present in the component as percent by weight diluent.

These examples are presented for illustrative purposes only, and are not intended to limit the scope of this invention.

TABLE I

| Components/Example | LUBRICANTS I (a) | II (b) | III (a) | IV (a) | V (a) |
|---|---|---|---|---|---|
| Base Oil | Exxon | Exxon | Exxon | Exxon | Exxon |
| Grade | 15W-40 | 5W-30 | 5W-30 | 5W-30 | 10W-40 |
| Product: Example 8 | | | | 9 | |
| Product: Example 9 | 10 | 9 | 9 | | 10 |
| Polyisobutenyl succinic anhydride - ethylene polyamine reaction product (55% oil) | 1.63 | 3.5 | 3.01 | 1.58 | 2.09 |
| Reaction product of pentaerythritol and ethylene polyamine with polyisobutenyl succinic anhydride (45% oil) | | | | | 0.80 |
| Zn mixed primary/secondary dialkyl dithiophosphate (12% oil) | 1.36 | | | | 1.36 |
| Zn secondary dialkyl dithiophosphate (10% oil) | | 0.75 | 0.9 | 0.79 | |
| Cu secondary dialkyl dithiophosphate (20% oil) | | 0.07 | 0.08 | 0.07 | |
| Ca overbased petroleum sulfonate, MR 12 (52% oil) | 0.60 | | | | |
| Ca overbased alkyl benzene sulfonate, MR 11 (41% oil) | | | | | 0.33 |
| Ca overbased alkyl benzene sulfonate MR = 20 (41% oil) | | | | | 0.32 |
| Ca overbased petroleum sulfonate MR 12 (48% oil) | | 0.73 | 0.49 | 0.44 | |
| Mg overbased alkyl benzene sulfonate, MR 14.7 (32% oil) | 0.37 | 0.2 | 0.17 | 0.29 | 0.38 |
| Mg overbased alkyl benzene sulfonate, MR 2.8 (34% oil) | | 0.45 | 0.22 | 0.15 | |
| Na overbased alkyl benzene sulfonate, MR 20 (18% oil) | | 0.25 | 0.30 | 0.26 | |
| Sulfurized alkyl phenol (42% oil) | 1.46 | 0.5 | 0.31 | .28 | 1.46 |
| Styrene-maleate copolymer (60% oil) | 0.08 | 0.2 | 0.08 | | |
| Fatty amide | | 0.10 | 0.1 | 0.09 | |
| Nonylphenoxy polyethoxy-ethanol | 0.12 | 0.10 | 0.11 | 0.10 | 0.12 |
| Silicone antifoam agent | 80 ppm | 70 ppm | 100 ppm | 61 ppm | 100 ppm |

(a) Percent by weight (oil free unless otherwise indicated)
(b) Percent by volume

EXAMPLE VI

A lubricating oil composition as in Example II employing 10% by weight of the product of Example 9.

EXAMPLE VII

A lubricating oil composition as in Example I employing 10.5% by weight of the product of Example 9.

EXAMPLE VIII

A lubricating oil composition as in Example I employing 11% by weight of the product of Example 9.

EXAMPLE IX

A lubricating oil composition as in Example III employing 9% by weight of the product of Example 8.

EXAMPLE X

A lubricating oil composition as in Example I employing 9% by weight of the product of Example 8.

EXAMPLE XI

A lubricating oil composition as in Example I employing 10% by weight of the product of Example 8.

EXAMPLE XII

A lubricating oil composition as in Example I employing 8.3% by weight of the product of Example 8.

EXAMPLE XIII

A lubricating oil composition as in Example V employing 5% by weight of the product of Example 9.

EXAMPLE XIV

A lubricating oil composition as in Example V employing 6..5% by weight of the product of Example 9.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispersant-viscosity improver for lubricating oil compositions comprising the reaction product of reactants comprising (a) an ethylene copolymer selected from the group consisting of an oil soluble ethylene-alpha olefin copolymer and an ethylene-lower olefin-diene copolymer, wherein the alpha olefin is selected from the group consisting of $C_{3-28}$ alpha olefins, said polymer having a number average molecular weight ranging from about 30,000 to about 300,000, grafted with an ethylenically unsaturated carboxylic acid or functional derivative thereof;

(b-1) at least one polyester containing at least one condensable hydroxyl group; and (b-2) at least one polyamine having at least one condensable primary or secondary amino group.

2. The dispersant-viscosity improver of claim 1 wherein the reactants further comprise (c) at least one hydrocarbyl substituted carboxylic acid or anhydride.

3. The dispersant-viscosity improver of claim 1 wherein the polyamine (b-2) is the reaction product of a polyamine and at least one hydrocarbyl substituted carboxylic acid or anhydride wherein the reaction product contains at least one condensable N—H group.

4. The dispersant-viscosity improver of claim 3 wherein the reaction product of a polyamine and carboxylic acid or anhydride is borated.

5. The dispersant-viscosity improver of claim 2 wherein (c) is first reacted with at least one of (b-1) and (b-2).

6. The dispersant-viscosity improver of claim 2 wherein (c) is reacted with the reaction product of (a), (b-1) and (b-2).

7. The dispersant-viscosity improver of claim 2 wherein (c) is reacted simultaneously with (a), (b-1) and (b-2).

8. The dispersant-viscosity improver of claim 1 wherein the polyamine (b-2) is first reacted with (a) the grafted ethylene-alpha olefin copolymer before reaction with (b-1) the polyester.

9. The dispersant-viscosity improver of claim 1 wherein (b-1) the polyester is first reacted with (a) the grafted ethylene-alpha olefin copolymer before reaction with (b-2) the polyamine.

10. The dispersant-viscosity improver of claim 1 wherein the copolymer is a copolymer of ethylene mid propylene.

11. The dispersant-viscosity improver of claim 1 wherein the copolymer has a number average molecular weight ranging from about 50,000 to about 150,000.

12. The dispersant-viscosity improver of claim 1 wherein the copolymer is an ethylene-lower olefin-diene copolymer.

13. The dispersant-viscosity improver of claim 12 wherein the diene is a non-conjugated diene.

14. The dispersant-viscosity improver of claim 12 wherein the copolymer is hydrogenated.

15. The dispersant-viscosity improver of claim 1 wherein the copolymer is a molecular weight degraded copolymer.

16. The dispersant-viscosity improver of claim 1 wherein the polyester (b-1) is the reaction product of a hydrocarbyl substituted polycarboxylic acid or anhydride with at least one polyol.

17. The dispersant-viscosity improver of claim 2 wherein the hydrocarbyl substituent of the hydrocarbyl substituted carboxylic acid or anhydride (c) contains at least about 8 carbon atoms.

18. The dispersant-viscosity improver of claim 17 wherein the hydrocarbyl substituent is an aliphatic group containing at least about 30 carbon atoms.

19. The dispersant-viscosity improver of claim 2 wherein (c) comprises a mixture of hydrocarbyl substituted carboxylic acids or anhydrides wherein the mixture comprises aliphatic substituted carboxylic acids or anhydrides containing from about 12 to about 24 carbon atoms in the aliphatic substituent and aliphatic substituted carboxylic acids or anhydrides having at least about 40 carbon atoms in the aliphatic substituent.

20. The dispersant-viscosity improver of claim 1 wherein the polyamine (b-2) is at least one member of the group consisting of alkylene polyamines having at least one N—H group, polyamine bottoms having at least one N—H group, polyoxyalkylene polyamines having at least one condensable N—H group, alkanol amines having at least one N—H group and derivatives of hydrocarbon-based monocarboxylic or hydrocarbon-substituted succinic acids with amines, said derivative containing at least one N—H group, or mixtures thereof.

21. The dispersant-viscosity improver of claim 20 wherein the polyamine (b-2) comprises at least one derivative of a hydrocarbon-substituted succinic acid wherein the hydrocarbon substituent contains from about 16 to about 100 aliphatic carbon atoms.

22. The dispersant-viscosity improver of claim 1 wherein the polyamine (b-2) comprises at least one alkylene polyamine having the formula $$\begin{array}{c} H-N-(\text{alkylene-NR})_n-R \\ | \\ R \end{array}$$

wherein n is a number from 1 to about 10, each R is independently hydrogen, a hydrocarbyl group having from 1 to about 30 carbon atoms or groups of the formula $$-\text{alkylene}-N(R)_2,$$

said alkylene group containing from 2 to about 10 carbon atoms.

23. The dispersant-viscosity improver of claim 1 wherein the polyamine (b-2) is selected from the group consisting of diethylenetriamine, triethylene tetramine, tetraethylenepentamine, pentaethylenehexamine, polyamine bottoms and mixtures thereof.

24. The dispersant-viscosity improver of claim 1 wherein (b-1) is a polyester of hydrocarbon-substituted monocarboxylic and dicarboxylic acids, said hydrocarbon substituent containing from 5 to about 500 carbon atoms.

25. The dispersant-viscosity improver of claim 1 wherein the polyester is derived from an aliphatic hydrocarbon substituted succinic acid containing from about 16 to about 100 carbon atoms in the aliphatic hydrocarbon substituent.

26. The dispersant-viscosity improver of claim 25 wherein the polyester is derived from at least one polyol selected from the group consisting of pentaerythritol, 2-ethyl-2-hydroxymethyl-1,3-propanediol, sorbitol, glycerol, a polyetherpolyol, 2-ethyl-2-amino-1,3-propanediol, tris-hydroxymethyl aminomethane, triethanolamine, diethanolamine, and mixtures of two or more of these.

27. The dispersant-viscosity improver of claim 1 wherein the ethylenically unsaturated carboxylic acid or functional derivative thereof, is an alpha, beta-unsaturated carboxylic acid or functional derivative thereof containing from 2 to about 20 carbon atoms exclusive of carbonyl carbons.

28. The dispersant-viscosity improver of claim 27 wherein the ethenylically unsaturated carboxylic acid or functional derivative thereof, comprises at least one member of the group consisting of maleic acid, maleic anhydride, fumaric acid, itaconic acid and itaconic anhydride and esters of the acids.

29. An oil soluble or dispersible composition comprising the reaction product of reactants comprising (a) an oil soluble copolymer of ethylene with at least one comonomer, wherein at least one of the comonomers is selected from the group consisting of $C_{3-28}$ alpha-olefins, said copolymer having a number average molecular weight ranging from about 30,000 to about 300,000, grafted with an alpha-beta ethylenically unsaturated carboxylic acid or functional derivative thereof;

(b-1) a polyisobutenyl substituted succinic polyester which contains an average of at least one free hydroxyl group per mole of succinic groups; and (b-2) an alkylene polyamine having the formula $$H_2N\text{—(alkylene-NR)}_n\text{—H}$$

wherein n is a number from 1 to about 10, each R is independently hydrogen, a hydrocarbyl group having from 1 to about 30 carbon atoms or a group of the formula $$\text{+alkylene—}\overset{\overset{\displaystyle R}{|}}{N}\text{)}_x\text{H}$$

wherein each x is independently 0 or a number from 1 to about 5, and said alkylene group contains from 2 to about 10 carbon atoms.

30. The composition of claim 29 wherein the reactants further comprise (c) at least one aliphatic hydrocarbon substituted carboxylic acid or anhydride.

31. The composition of claim 30 wherein (c) the carboxylic acid or anhydride is a monocarboxylic acid or anhydride.

32. The composition of claim 30 wherein (c) the carboxylic acid or anhydride is a polycarboxylic acid or anhydride.

33. The composition of claim 29 wherein the copolymer is a copolymer of ethylene and propylene.

34. The composition of claim 29 wherein the copolymer has a number average molecular weight ranging from about 50,000 to about 150,000.

35. The composition of claim 29 wherein the copolymer is an ethylene-lower olefin-diene copolymer.

36. The composition of claim 35 wherein the diene is a non-conjugated diene.

37. The composition of claim 35 wherein the copolymer is hydrogenated.

38. The composition of claim 29 wherein the copolymer is a molecular weight degraded copolymer.

39. The composition of claim 29 wherein the each polyisobutenyl group on (b-1) the polyester has from about 30 to about 150 carbon atoms, and said polyester is a pentaerythritol polyester.

40. The composition of claim 29 wherein the amine (b-2) comprises ethylene polyamine bottoms.

41. The composition of claim 29 wherein each R in the amine (b-2) is hydrogen.

42. The composition of claim 29 wherein grafting of the ethylene copolymer is conducted at about 100° C. to about 200° C. in the presence of a free radical initiator.

43. The composition of claim 29 wherein the polyester (b-2) has been post treated with about 0.2 to about 5 equivalents of an ethylene polyamine per mole of succinic groups in the polyester.

44. An additive concentrate comprising an inert normally liquid organic diluent and from about 5 to about 40 percent by weight of the dispersant-viscosity improver of claim 1.

45. An additive concentrate comprising an inert normally liquid organic diluent and from about 5 to about 40 percent by weight of the composition of claim 29.

46. The additive concentrate of claim 44 further comprising from about 1% to about 5% by weight of at least one pour point depressant selected from the group consisting of polymethacrylates, alkylated naphthalenes and maleate/vinyl acetate copolymers.

47. The additive concentrate of claim 45 further comprising from about 1% to about 5% by weight of at least pour point depressant selected from the group consisting of polymethacrylates, alkylated naphthalenes and maleate/vinyl acetate copolymers.

48. A lubricating composition comprising a major amount of an oil of lubricating viscosity and a minor amount of the dispersant-viscosity improver of claim 1.

49. A lubricating composition comprising a major amount of an oil of lubricating viscosity and a minor amount of the composition of claim 29.

50. A lubricating composition comprising a major amount of an oil of lubricating viscosity and a minor amount of the additive concentrate of claim 44.

51. A lubricating composition comprising a major amount of an oil of lubricating viscosity and a minor amount of the additive concentrate of claim 45.

* * * * *